United States Patent [19]

Christopher

[11] 4,075,879

[45] Feb. 28, 1978

[54] MULTIPLE FUNCTION PLATE TUMBLER-TYPE CYLINDER LOCK MECHANISM

[75] Inventor: Walter S. Christopher, Park Ridge, Ill.

[73] Assignee: Chicago Lock Co., Chicago, Ill.

[21] Appl. No.: 808,971

[22] Filed: Jun. 22, 1977

[51] Int. Cl.[2] ..... E05B 9/04; E05B 29/02; E05B 35/08

[52] U.S. Cl. ..... 70/337; 70/364 R; 70/373

[58] Field of Search ..... 70/337, 338, 339, 340, 70/341, 342, 343, 364 R, 364 A, 373

[56] References Cited

U.S. PATENT DOCUMENTS

| | | | |
|---|---|---|---|
| 1,785,634 | 12/1930 | Lawrence | 70/337 |
| 2,580,882 | 1/1952 | Blohm | 70/340 |
| 3,973,421 | 8/1976 | Patriquim | 70/364 R |

OTHER PUBLICATIONS

Prior art of Chicago Lock Co. submitted with application.

*Primary Examiner*—Robert L. Wolfe
*Attorney, Agent, or Firm*—Norman H. Gerlach

[57] ABSTRACT

A plate tumbler-type cylinder lock mechanism includes a plurality of longitudinal internal splines therearound adapted for receiving tumbler ends, means providing at least three internal circumferentially extending tumbler movement paths on the barrel and extending between one spline and another spline which is different for each path, a key plug assembly rotatable in the barrel and including a key plug and a plurality of spring-pressed plate tumblers mounted in the plug, the tumblers being mounted for reciprocal transverse movement upon insertion and withdrawal of a bitted key with opposite tumbler ends projecting alternately from opposite sides of the plug, certain tumblers being adapted to be projected outwardly with their ends in respective registering movement paths when a key is inserted, whereby such ends may travel in the movement paths when the plug is rotated, and means adjacent to at least one end of each movement path adapted for engagement with the tumbler end traveling in the path to prevent travel thereof beyond such end, whereby a plurality of different keys may be employed for rotating the plug assembly with each key rotating the assembly to a different limited extent, such keys each engaging a different one of the tumblers having an end registering with a movement path, to cause such end to project into the movement path and thereby limit rotation of the plug assembly.

12 Claims, 16 Drawing Figures

MULTIPLE FUNCTION PLATE TUMBLER-TYPE CYLINDER LOCK MECHANISM

BACKGROUND OF THE INVENTION

This invention relates to a multiple function plate tumbler-type cylinder lock mechanism. More particularly, the invention relates to a lock mechanism which is operated by three or more keys to perform an equal number of functions.

Cash registers and other enclosures frequently are secured by a lock mechanism which is supplied with two keys for use alternatively to perform one of two functions, depending on which key is used. Thus, for example, the operation of a cash register may be controlled by an electrical switch operated by a lock mechanism. One key may be supplied to a teller, such key being inserted in the lock mechanism and turned in one direction or the other and to the extent necessary for providing limited access to the cash register. A second key may be supplied to a supervisor, and such key may be turned in an appropriate direction and to an appropriate extent for providing greater access to the register.

A demand exists for an acceptable lock mechanism which will perform more than two functions, by operation with a corresponding number of different keys. As an example, in addition to performing the above-described functions, it may be desirable that the lock mechanism be operable to provide an additional type of access to an auditor. It may be desirable also that such access be given while retaining the key captive in the lock mechanism, i.e., not removable, to minimize the possibility that the mechanism will be left in a condition allowing access to the register.

SUMMARY OF THE INVENTION

The present invention provides a cylinder lock mechanism which performs a multiplicity of functions upon operation by a corresponding number of keys. The lock mechanism includes a barrel having a plurality of longitudinal internal splines therearound adapted for receiving tumbler ends, means providing at least three internal circumferentially extending tumbler movement paths on the barrel having proximal ends disposed in a first one of the splines and terminating at distal ends in respectively different ones of the splines, a key plug assembly rotatably mounted in the barrel and including a key plug and a plurality of spring-pressed plate tumblers mounted in the plug in a longitudinal series, the tumblers being mounted for reciprocal transverse movement upon insertion and withdrawal of a bitted key with opposite tumbler ends projecting alternately from opposite sides of the plug, first ones of the tumbler ends being spring-pressed to project outwardly for reception in a second one of the splines to secure the plug assembly initially in the absence of a key, the second spline being diametrically opposed to the first spline, opposite second ones of the tumbler ends being adapted to be projected outwardly and received in the first spline when a key is inserted for the purpose of freeing the plug assembly for rotation, different ones of the second tumbler ends registering with respective movement path proximal ends whereby when such tumbler ends are projected outwardly they may travel in the movement paths between the proximal and distal ends thereof, and means adjacent to at least one end of each movement path adapted for engagement with the tumbler and traveling in the path to prevent travel thereof beyond such path end, whereby a plurality of different keys may be employed for rotating the plug assembly with each key rotating the assembly to a different limited extent, such keys each engaging a different one of the tumblers having a second end registering with a movement path to cause such end to project into the movement path and thereby limit rotation of the plug assembly.

In a preferred embodiment of the invention, an internal land is provided in longitudinal alignment with the distal end of one of the movement paths and in transverse alignment with at least one tumbler not registering with the movement path. The land serves to prevent removal of one of the keys, that is, the key engaging the tumbler which travels in the one movement path when the key is turned. A spline is provided in longitudinal alignment with the land, so that another key may be removed after turning to a position 180° from the land, and the latter spline will receive one or more tumbler ends therein, for the purpose of securing the lock at such time.

Additional preferred embodiments include the provision of movement paths extending in opposite directions from their proximal ends in the first spline. The distal ends of the movement paths preferably are disposed at least 60° from the first spline and from each other, to safeguard against failure of the lock mechanism and, particularly, of the tumblers.

BRIEF DESCRIPTION OF THE DRAWINGS

The attached drawings illustrate a preferred embodiment of the invention, without limitation thereto. In the drawings, like elements are identified by like reference symbols in each of the views, and.

DESCRIPTION OF THE PREFERRED EMBODIMENT

Figure 1:
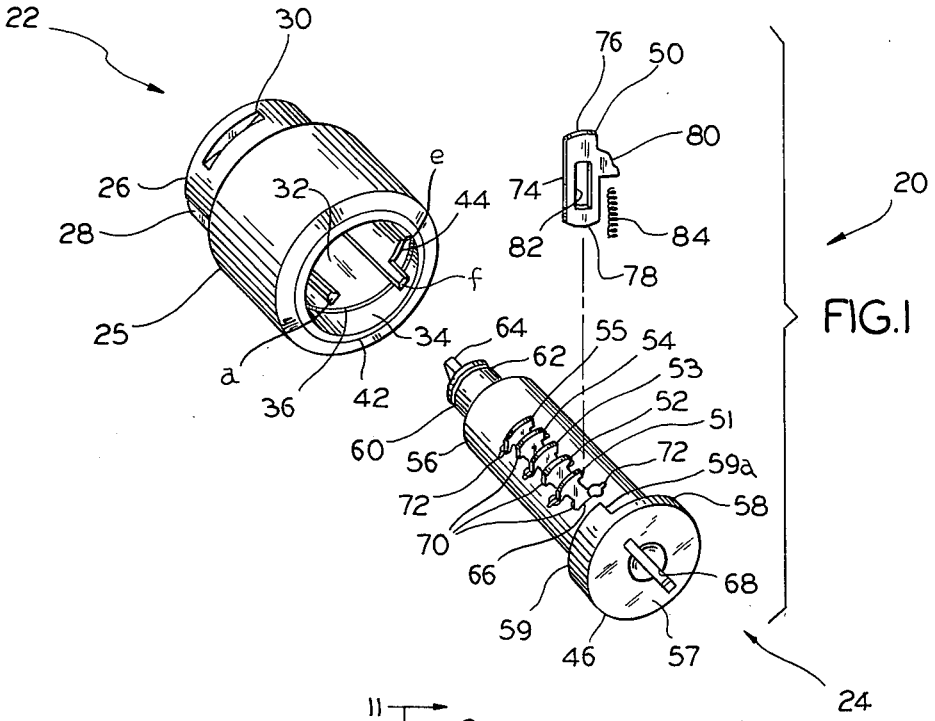
FIG. 1 is an exploded perspective view of the lock mechanism of the invention.

Referring to the drawings, a plate tumbler-type cylinder lock mechanism 20 representing a preferred embodiment of the invention is illustrated in FIG. 1. The lock mechanism 20 is operated to perform three different functions by an "A" key illustrated in FIG. 3, a "B" key illustrated in FIG. 4, and a "C" key illustrated in FIG. 5, which keys are single-bitted.

Figure 2:
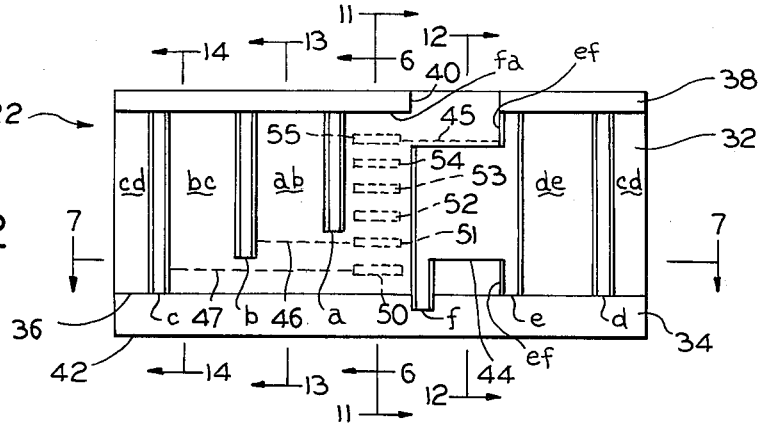
FIG. 2 is an enlarged developed view of a barrel in the mechanism.

Referring to FIGS. 1 and 2, the lock mechanism 20 includes a generally cylindrical tubular barrel 22 and a key plug assembly 24 which is rotatable in the barrel. The barrel 22 has a generally cylindrical front portion 25 and a reduced diameter rear portion 26 integral therewith. The rear portion is generally cylindrical, with flats 28 and grooves 30 provided on its outer surface, for mounting the lock mechanism 20 in a cash register or other enclosure, in a conventional manner.

The front portion 25 and the rear portion 26 together define generally cylindrical inner wall surfaces, including a rearwardly disposed wall surface 32 and an enlarged forwardly disposed wall surface 34 joining the rearwardly disposed surface at an annular shoulder 36. An arcuate flange 38 extends inwardly from the rear end of the rearwardly disposed wall surface 32, and terminates at opposite ends adjacent to a broach passage 40 therebetween.

The barrel 22 has a series of longitudinal internal ribs *a, b, c, d, e,* and *f* equidistantly spaced therearound. The ribs are integral with the rear inner wall surface 32, and the rear ends of ribs *a–e* are integral with the flange 38. Ribs *c–e* extend from the flange 38 to the shoulder 36, and ribs *a* and *b* extend for lesser distances forwardly from the flange 38, for reasons which will appear. Rib *f* is spaced forwardly from the flange 38, and it extends past the shoulder 36, onto the forward wall surface 34 and integral therewith, short of the front edge 42 of the barrel, also for reasons which will appear. A land 44 is integral with the rear wall surface 32 and with ribs *e* and *f,* between which it extends. The land 44 is spaced forwardly from the flange 38 and rearwardly from the shoulder 36. The radial thicknesses of the ribs *a–f* and the land 44 are approximately the same.

The ribs *a–f* define between them a plurality of longitudinal internal splines adapted for receiving tumbler ends. Such splines are identified by the symbols of the ribs between which they extend, as *ab, bc, cd, de, ef,* and *fa.* Splines *fa, cd, ef,* and *bc* are referred to hereinafter at times as the first, second, third, and fourth splines, respectively. The longitudinal spacing arrangements of the ribs *a–c, e* and *f,* and the land 44 are such as to provide three circumferentially extending arcuate tumbler movement paths on the barrel 22, such paths being illustrated by broken lines and identified by the numbers 45, 46, and 47. The movement paths 45–47 have proximal ends disposed in spline *fa,* otherwise identified as the first spline. The movement paths 45–47 terminate at distal ends in respectively different ones of the splines, identified as splines *ef, ab,* and *bc.*

Figure 15:
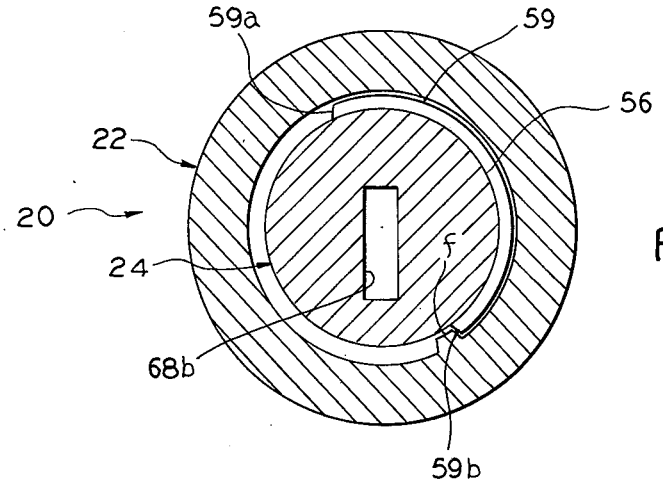
FIGS. 15 and 16 are enlarged cross sectional views of the lock mechanism, taken substantially on lines 15—15 and 16—16, respectively, of FIGS. 12 and 14.

The key plug assembly 24 includes a generally cylindrical key plug 46 and a plurality of spring-pressed plate tumblers 50–55 mounted in the plug in a longitudinal series. The construction of the plug assembly 24 and the elements thereof are, in general, conventional. Thus, the plug 46 includes a generally cylindrical body 56, and an integral enlarged circular head 57 at the front end of the body. The head 57 includes an annular rim 58 which projects radially beyond the body 56. An arcuate stop lug 59 is integral with the rim 58 and projects rearwardly therefrom. The stop lug 59 provides first and second stop shoulders 59*a* and 59*b* (see FIGS. 15 and 16), respectively, at its opposite extremities. A reduced diameter stub shaft 60 is integral with and extends rearwardly from the rear end of the body. An annular groove 62 is provided on the shaft 60, and a rectangular tang 64 is integral with and extends rearwardly from the shaft 60.

A longitudinal slot 66 is provided in the plug body 56 intermediate its ends, and the slot extends diametrically through the body. A keyway 68 extends longitudinally through the head 57 and into the body 56, and it registers with the longitudinal slot 66. Six transversely extending, generally rectangular tumbler-receiving slots 70 extend diametrically through the plug body 56, in spaced parallel relation to each other in a longitudinal series and intersecting the longitudinal slot 66. A cylindrical blind bore 72 is formed in the plug body 56 in communication with each of the tumbler-receiving slots 70 along one edge thereof.

Figure 7:
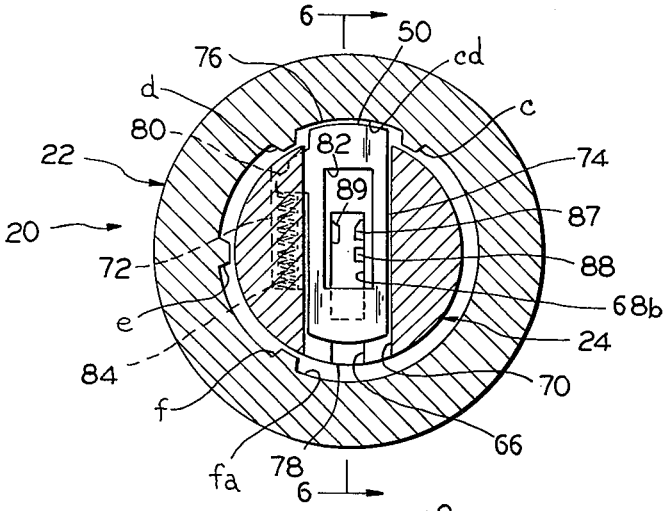
FIG. 7 is an enlarged cross sectional view of the lock mechanism, taken substantially on line 7—7 of FIG. 6.

Referring to FIGS. 1 and 7, each plate tumbler 50–55 has an elongated body 74 having opposite convex first and second ends 76 and 78, respectively, and an integral shoulder 80 projecting outwardly from a side edge of the body 74. The body 74 is provided with a rectangular key-receiving opening 82 which, in the illustrative embodiment, is congruent with the opening in every other tumbler. The opening 82 in each tumbler may be spaced between the opposite ends 76 and 78 the same as or differently from the spacing in other tumblers, its disposition being chosen so as to provide the desired performance and key code.

The tumblers 50–55 are mounted in the transverse slots 70 in the plug body 56, with a coil compression tumbler spring 84 seated in each of the blind bores 72 and the shoulder 80 of the adjacent tumbler seated thereon, whereby the tumbler is urged radially outwardly from the body 56. The tumblers 50–55 are retained in the plug by peening portions of the body 56 in place over the shoulders 80. The tumblers 50–55 are mounted in this manner for reciprocal transverse movement upon insertion and withdrawal of a bitted key, with opposite tumbler ends 76 and 78 projecting alternately from opposite sides of the plug body 56, as will become apparent in connection with the description of FIGS. 6–14.

Figure 6:
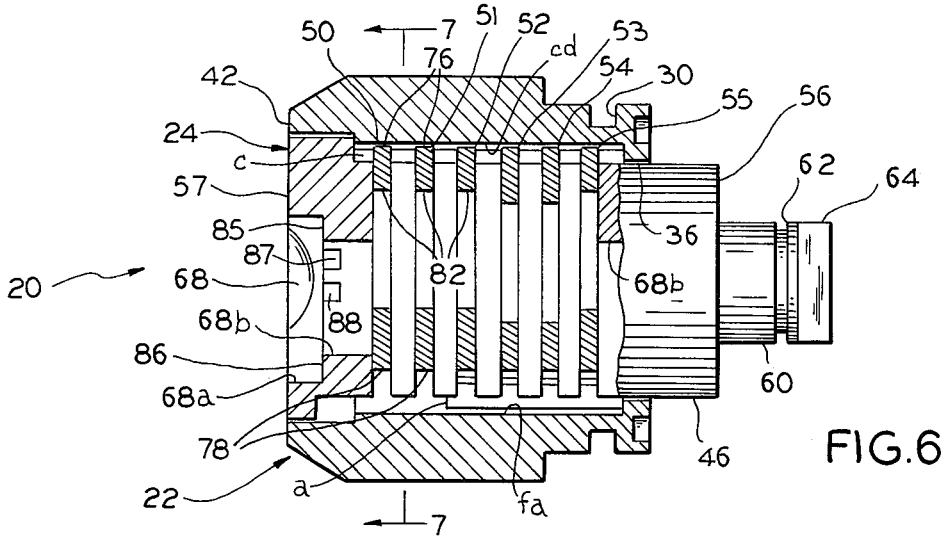
FIG. 6 is an enlarged longitudinal sectional view of the lock mechanism, in its locked initial condition, taken substantially on lines 6—6 of FIGS. 2 and 7.

Referring to FIGS. 1, 6 and 7, the keyway 68 includes a rectangular outer portion 68*a* at the face of the head 57, and a rectangular inner portion 68*b* of reduced width extending from the outer portion into the body 56. Key abutment shoulders 85 and 86 are formed at the junctures of the outer portion 68*a* and the inner portion 68*b.* Guide lugs or wards 87–89 are integral with the head 57 and extend inwardly from the inner portion 68*b* of the keyway.

The barrel 22 and the key plug assembly 24 are assembled by inserting the shaft 60 and the body 56 of the plug 46 into the barrel at its front end. The plug body 56 is journaled in the rear end flange 36 of the barrel and also is closely surrounded by the ribs *a–f.* The shaft 60 projects rearwardly from the barrel 22. The rim 58 of the head 57 abuts on the front end of the rib *f*, and the stop lug 59 on the rim abuts on the shoulder 36 in the barrel. The rim 58 is received within the front portion 25 of the barrel closely adjacent to the forward inner wall surface 34, with the front face of the head 57 substantially flush with the front edge 42 of the barrel.

The lock mechanism 20 is illustrated in its initial, locked condition in FIGS. 6 and 7. The illustrative mechanism is constructed for use with an electrical switch, not shown. The switch may be mounted on the shaft 60 with the tang 64 engaging a rotatable element of the switch. The groove 62 may be utilized for connecting the lock mechanism to the switch, and when the members are assembled, the switch housing adjoins the inner end of the barrel 22 and serves to hold the plug assembly 24 rotatably therein.

Figure 3:
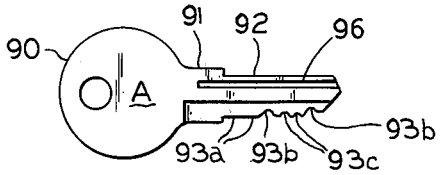
FIGS. 3–5 are side elevational views of three keys employed with the lock mechanism, on a slightly reduced scale.
Figure 4:
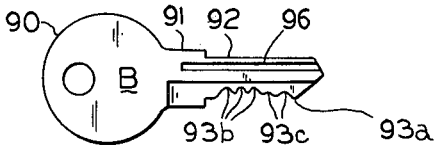
Figure 5:
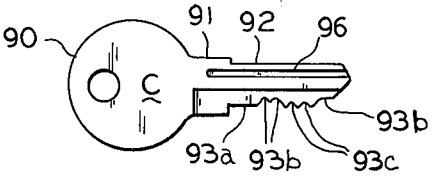
Figure 8:
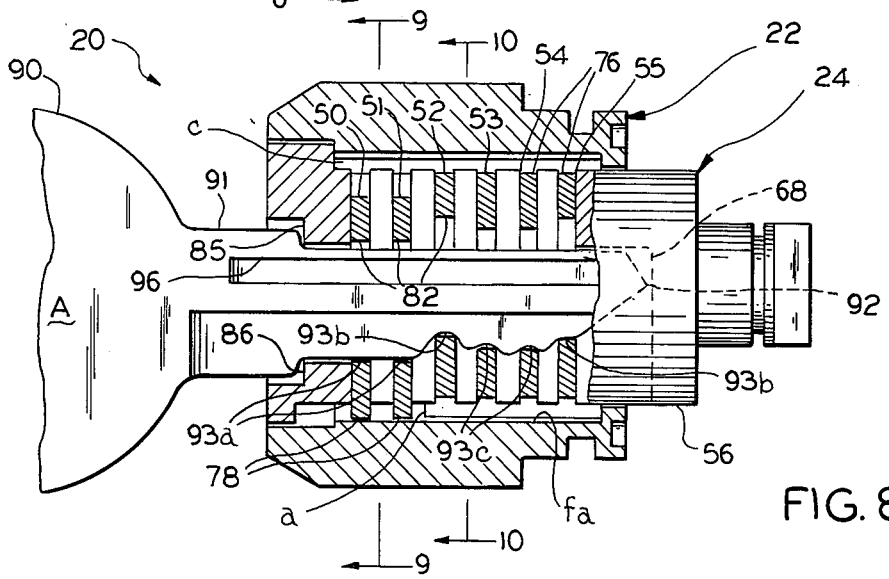
FIG. 8 is a view like FIG. 6 but with the key of FIG. 3 inserted.
Figure 9:
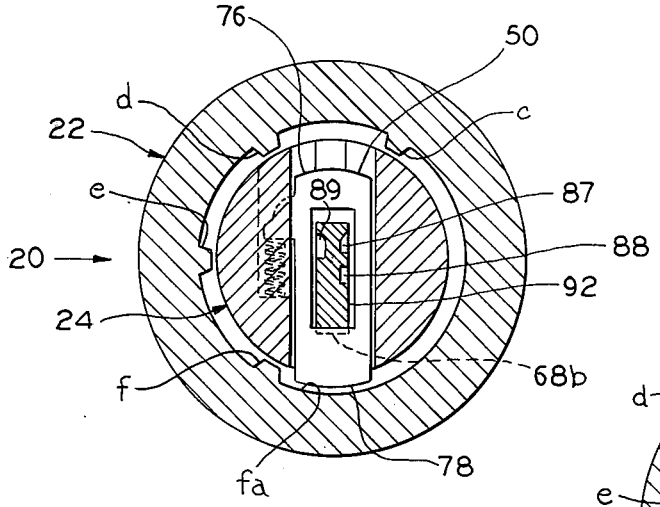
FIGS. 9 and 10 are views like FIG. 7 but taken substantially on lines 9—9 and 10—10, respectively, of FIG. 8.
Figure 10:
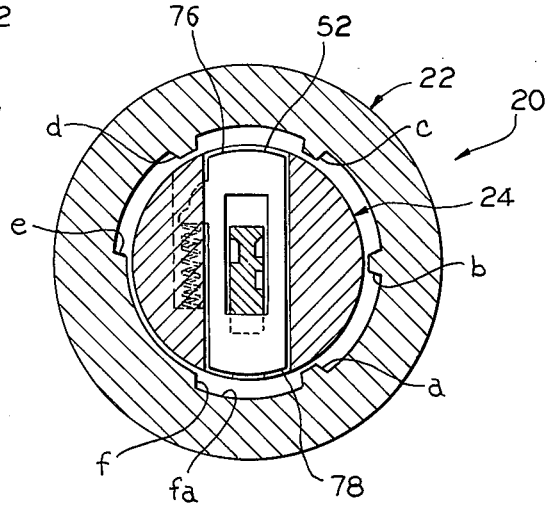

Referring to FIGS. 3–5, the "A ", "B", and "C" keys are cut similarly, there being differences only in certain bittings thereof. Each key includes a flat bow 90, a shank 91 extending therefrom, and a bit 92 extending from the shank. Referring also to FIGS. 8 and 12, guide grooves 94–96 are provided in the shank 91 and the bit 92, and they are complementary to the guide lugs 87–89, respectively. Each key has six bittings 93, corresponding to the number of tumblers 50–55. Individual bittings are identified additionally by a letter symbol, the same symbol being used for all bittings having the same depth of cut. Thus, the "A" key, illustrated in FIG. 3, has, in succession, two bittings 93*a*, one bitting 93*b*, two bittings 93*c*, and one bitting 93*b*. The "B" key illustrated in FIG. 4, has, in succession, three bittings 93*b*, two bittings 93*c*, and one bitting 93*a*. The "C" key, illustrated in FIG. 5, has, in succession, one bitting 93*a*, two bittings 93 *b*, two bittings 93*c*, and one bitting 93*b*. As illustrated in FIGS. 8 and 11–13, when any of the keys is fully inserted in the keyway 68, the shank 91 of the key abuts against the shoulders 85 and 86 in the keyway, the guide lugs 87–89 in the keyway are received in the guide grooves 94–96 in the key, the bit 92 of the key extends through the openings 82 in the tumblers 50–55, and the bittings 93 on the key engage the tumblers in their openings.

Referring to FIGS. 2, 6 and 7, the tumblers 50–55 are biased by the springs 84 in the direction of the second spline *cd*, so that the first tumbler ends 76 project outwardly from the plug body 56 and are received in the spline when the lock mechanism is in its initial, locked condition. The first ends 76 of the six tumblers lie between the ribs *c* and *d*, to secure the plug assembly 24 against rotation relative to the barrel 22.

Referring to FIGS. 2 and 8–10, the second tumbler ends 78 are adapted to be projected outwardly and received in the first spline *fa* when a key is inserted for the purpose of freeing the plug assembly 24 for rotation. Thus, when the "A" key is inserted in the keyway 68 and through the openings 82 in the tumblers 50–55, the tumblers reciprocate during insertion of the key, as the bittings 93 traverse the tumblers in engagement therewith. During this reciprocation, the second tumbler ends 78 at times project outwardly beyond the plug body 56.

The second ends 78 of the tumblers 50, 51, and 55 register with the proximal ends of the movement paths 47, 46, and 45, respectively, as represented in FIG. 2. When the "A" key is fully inserted, the second ends 78 of the tumblers 50 and 51 project outwardly into the first spline *fa* (see FIGS. 8 and 9) and into the respective movement paths 47 and 46 (FIG. 2) at their proximal ends, and such tumbler ends continue to project so long as the key is inserted. The remaining tumblers 52–55 are held within the plug body 56 by the key (see FIGS. 8 and 10), to permit rotation thereof.

At this time, the shank 91 of the "A" key abuts on the shoulders 85 and 86 in the plug head 57, to determine the position of the key bit 92. Commencing at the outer end of the bit 92, adjacent to the shank 91, two bittings 93*a*, which are provided by the key blank without cutting, engage the tumblers 50 and 51 to positively hold them in the illustrated (FIGS. 8 and 9) outwardly extending position, against the bias of the tumbler springs 84, with the second tumbler ends 78 received in the first spline *fa*. The tumblers 52–55 engage the key bittings 93*b*, 93*c*, 93*c*, and 93*b*, respectively to positively hold the tumblers within the plug body 56 against the spring bias. The tumblers are held by the key in this manner with no freedom of movement in the opposite direction. For this reason, the side of the plug assembly 24 from which the second tumbler ends 78 extend is referred to as the "hard side. " The opposite side, from which the first tumbler ends 76 extend initially, is referred to as the "soft side," having reference to the fact that the tumbler ends 76 may be pushed inwardly against the bias of the springs 84. The second ends 78, then, are positively extended by the key, and perform their intended functions reliably, without dependence on spring pressure.

It will be seen on reference to FIG. 2 that the second ends 78 of the tumblers 50 and 51 are adapted for engaging the rib *f*, to prevent travel of the tumbler ends beyond the proximal ends of the movement paths 46 and 47, and thereby prevent counterclockwise rotation of the plug assembly 24. When the plug assembly 24 is rotated in the clockwise direction, the second tumbler ends 78 travel in the movement paths 46 and 47, until the second end 78 of the second tumbler 51 engages the spline *b*, with the tumbler end in the distal end of its movement path 46, which is in the spline *ab*. Thus, the plug assembly 24 may be rotated for 60° in the clockwise direction by turning the "A" key, and the rotation is limited to such extent by the limitation of travel of the second end 78 of the second tumbler 51.

The "A" key may be removed in the rotated position, with the spline *ab* providing clearance for projection of the second ends 78 of all of the tumblers 50–55 thereinto as the key is removed. With the key removed, the first tumbler ends 76 project into the opposite spline *de*, at 180° thereto, similarly to the illustrations of FIGS. 6 and 7. The ribs *e* and *d* on opposite sides of the first tumbler ends 76 then prevent the tumblers 50–55 and thereby the plug assembly 24 from rotating, so that the plug assembly is secured against rotation relative to the barrel 22 in the rotated position. The plug assembly 24 may be restored to its initial condition, illustrated in FIGS. 6 and 7, by inserting the "A" key, turning the plug assembly 24 for 60° in the counterclockwise direction, and removing the key.

Figure 11:
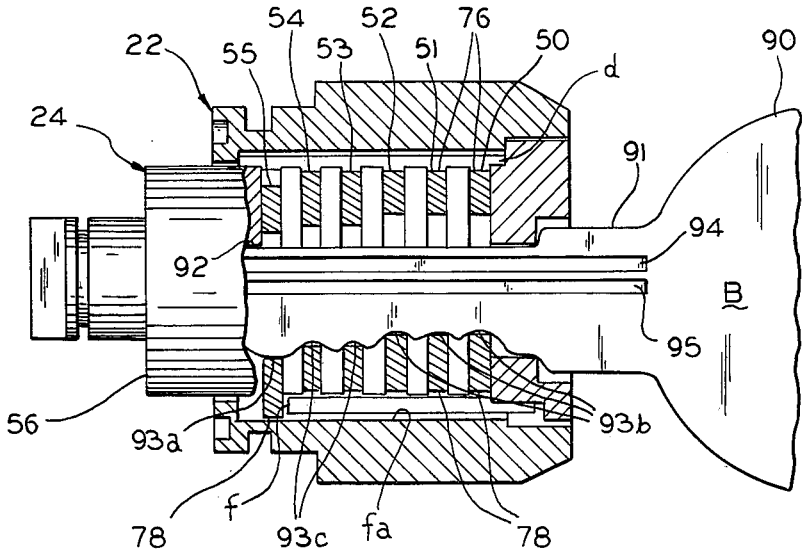
FIG. 11 is an enlarged longitudinal sectional view of the lock mechanism with the key of FIG. 4 inserted, taken substantially on line 11—11 of FIG. 2, showing the plug assembly thereof in its initial position.
Figure 12:
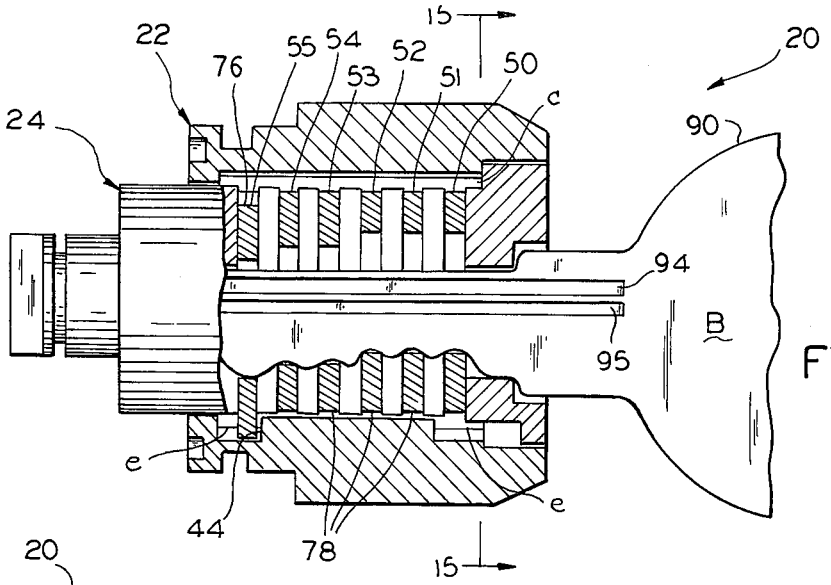
FIG. 12 is an enlarged longitudinal sectional view of the lock mechanism with the key of FIG. 4 inserted, taken substantially on line 12—12 of FIG. 2, showing the plug assembly rotated 60° in the counterclockwise direction, as viewed from the front of the lock mechanism.

When the "B" key is inserted in the keyway 68 with the lock mechanism 20 in its initial condition, the tumblers 50–55 are engaged by the key bit 92 and moved into the positions illustrated in FIG. 11. In this case, the bittings 93*b*, 93*b*, 93*b*, 93*c*, and 93*c* engage the tumblers 50–54, respectively, to position them within the confines of the plug body 56. The bitting 93*a* at the inner end of the bit 92 engages the rearmost tumbler 55 and moves it outwardly on the hard side of the plug assembly 24, so that its second end 78 is received in the first spline *fa*, at the proximal end of the movement path 45 with which the tumbler end registers (see also FIG. 2).

The second end 78 of the tumbler 55 is adapted for engagement with the adjacent rib *a*, whereby clockwise rotation thereof and of the plug assembly 24 is prevented. With the rib *f* on the opposite side of the tumbler end 78, and the adjoining land 44, spaced forwardly from the flange 38, leaving the path 45, the second end 78 of the tumbler 55 and thus the plug assembly 24 may be rotated in the counterclockwise direction. The plug assembly 24 may be rotated for 60°, until the second end 78 of the tumbler 55 reaches the distal end of the movement path 45, in the third spline *ef*, adjacent to the rib *e*. This condition is illustrated in FIG. 12. While further rotation may be prevented by engagement of the projecting second end 78 of the tumbler 55 with the rib *e*, it is preferred to employ the stop means provided for such purpose and thereby avoid damage to the tumbler. Thus, referring to FIG. 15, the second stop shoulder **59*b* on the plug head 57** engages the forwardly projecting portion of the rib *f*, thereby interengaging the plug 46 and the barrel 22 to prevent further relative rotation therebetween.

As illustrated in FIGS. 2 and 12, the land 44 is in longitudinal alignment with the distal end of the movement path 45, and in transverse alignment with tumblers 51–54. When the plug assembly 24 is rotated for 60° in the counterclockwise direction, and is in the position illustrated in FIG. 12, the land 44 is longitudinally aligned with the tumblers 50 and 55 adjacent opposite ends of the land, and disposed radially outwardly of the intermediate tumblers 51–54. The second ends 78 of the latter tumblers are closely adjacent to the land 44, so that they are prevented from moving outwardly for a sufficient distance to allow the "B" key to be removed when in the rotated position. The "B" key can be removed only when the plug assembly is rotated in the clockwise direction to restore it to the disposition of FIG. 11, in which all of the second tumbler ends 78 are free to move outwardly into the first spline *fa*. Thus, the "B" key is removable only when the lock mechanism 20 is in its initial, locked condition.

Figure 13:
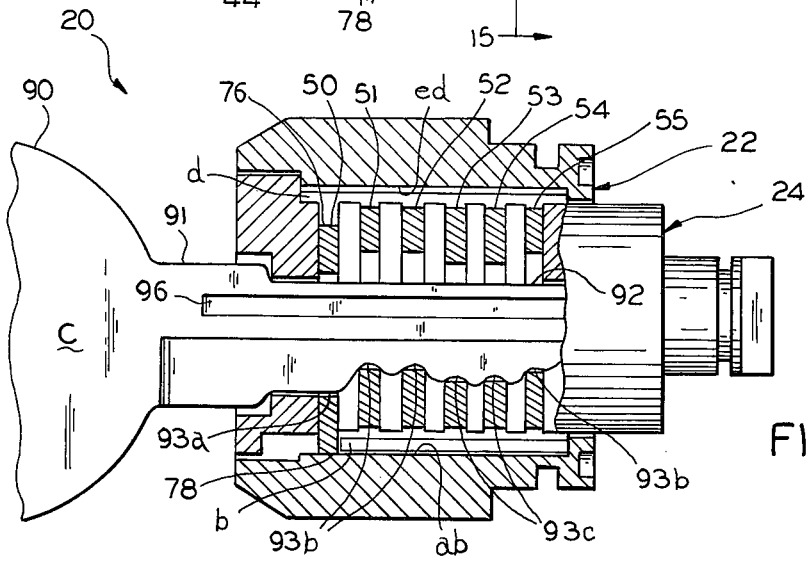
FIG. 13 is an enlarged longitudinal sectional view of the lock mechanism with the key of FIG. 5 inserted, taken substantially on line 13—13 of FIG. 2, showing the plug assembly rotated 60° in the clockwise direction.

When the "C" key is inserted in the keyway 68 with the lock mechanism 20 in its initial condition, the tumblers 50–55 are engaged by the key bit 92 and moved into the positions illustrated in FIG. 13. In this case, the bitting **93*a* adjacent to the shank 91 engages the frontmost tumbler 50 and moves it outwardly on the hard side of the plug assembly 24, so that its second end 78** is received in the first spline *fa*, at the proximal end of the movement path 47 with which the tumbler end registers (see also FIG. 2). The remaining bittings **93*b*, 93*b*, 93*c*, 93*c*, and 93*b* engage the tumblers 51–55, respectively, to position them within the confines of the plug body 56**.

The second end 78 of the tumbler 50 is adapted for engagement with the adjacent rib *f*, whereby counterclockwise rotation thereof and of the plug assembly 24 is prevented. Inasmuch as the movement path 47 clears both of the ribs *a* and *b*, which are spaced rearwardly from the shoulder 36, the plug assembly 24 may be rotated for 60° in the clockwise direction, as illustrated in FIG. 13, or for 120° in the clockwise direction, so that the "C" key may be used to perform either of two functions. In the latter case, the plug assembly 24 is rotated until the second end 78 of the tumbler 50 reaches the distal end of the movement path 47, in the fourth spline *bc*, adjacent to the rib *c*. While further rotation may be prevented by engagement of the projecting second end 78 of the tumbler 50 with the rib *c*, it is preferred to employ the stop means provided, again to avoid damage to the tumbler. Thus, referring to FIG. 16, the first stop shoulder **59*a* on the plug end 57** engages the forwardly projecting portion of the rib *f*, thereby interengaging the plug 46 and the barrel 22 to prevent further relative rotation therebetween. It will be observed, therefore, that the rib *f* on the barrel, and the stop shoulders **59*a* and 59*b* on the plug assembly provide interengaging stop means adapted to limit rotation of the plug assembly at the opposite extremes of the several movement paths, i.e., at the distal ends of the movement paths 45 and 47**.

Figure 14:
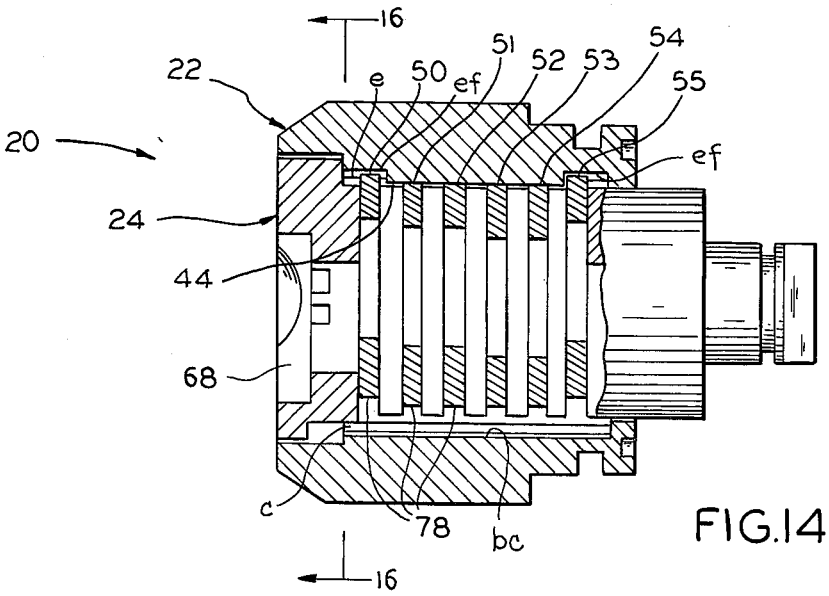
FIG. 14 is an enlarged longitudinal sectional view of the lock mechanism, taken substantially on line 14—14 of FIG. 2, showing the plug assembly rotated 120° in the clockwise direction and with the key removed to place the mechanism in locked condition.
Figure 16:
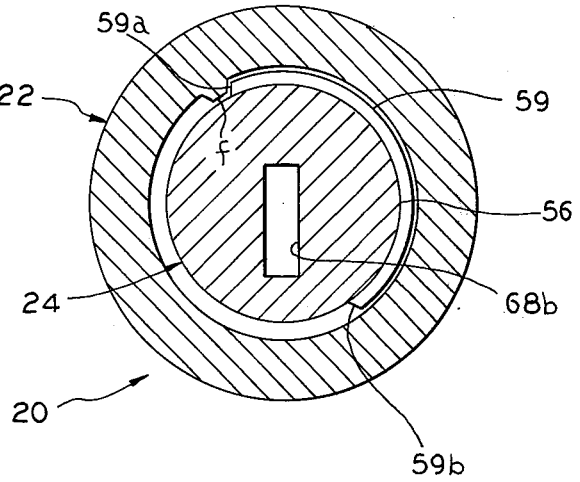

The second tumbler ends 78 register with the spline *ab* at 60° of rotation of the plug assembly 24, and with the spline *bc* (the fourth spline) at 120° of rotation, so that the "C" key may be removed at either position. At 60° of rotation, and with the key removed, the first tumbler ends 76 are received in the spline *de*, diametrically opposed to the spline *ab*, with the ribs *e* and *d* on opposite sides of the tumbler ends to secure the plug assembly. At 120° of rotation, and with the key removed, the first ends 76 of the front and rear tumblers 50 and 55 are received in the third spline *ef*, diametrically opposed to the fourth spline *bc*, on opposite sides of the land 44, as illustrated in FIG. 14. The remaining tumblers 51–54 bear against the land 44. In this position, the ribs *e* and *f* are disposed on opposite sides of the frontmost tumbler 50, and the rib *e* is disposed on one side of the rearmost tumbler 55, for the prevention of rotation of the plug assembly 24. Referring to FIG. 16, the plug assembly 24 is further secured by engagement of the first stop shoulder **59*a*** with the forwardly projecting end of the rib *f*. The "C" key may be inserted in the plug assembly 24 in either of its 60° and 120° rotated positions, for rotating the plug assembly to the other of such positions, or for restoring it to its initial position, and the key may be removed to leave the lock mechanism 20 in locked condition in each case.

It is preferred that the distal ends of the movement paths 45–47 be disposed at least 60° from the first spline *fa* and from each other, providing key turns in increments of at least 60°. Such angular spacing enables the tumblers 50–55 and the ribs *a–f* to be constructed with dimensions adequate to withstand the stresses encountered and avoid failure of the lock mechanism. The angular spacing is especially desirable where the commonly used ½ inch diameter plug body 56 is employed.

Depending upon the desired functions, it may be satisfactory to extend all of the movement paths in the same direction from the first spline *fa*. The illustrative embodiment, in which one path 45 extends in the opposite direction from the remaining two paths 46 and 47, minimizes the overlapping of movement paths and provides the most restricted access by holders of individual keys.

The illustrative embodiment, in which the front two tumblers 50 and 51 and the rearmost tumbler 55 are selected for operation by the keys to control rotation of the plug assembly 24, is preferred for manufacturing purposes, inasmuch as the barrel 22 may be cored from its opposite ends. Also, such utilization of tumblers at both ends of the plug assembly 24 serves to provide maximum structural support. However, if desired, any of the remaining tumblers 52, 53 and 54 may be employed similarly, with suitable provision of movement paths, and suitable rib and land structure. The directions in which the movement paths extend may be varied, as suitable for performing the desired functions.

With sufficient radial thickness of the ribs *a–f*, a full range of key changes may be provided for the lock mechanism 20. The illustrative use of six tumblers 50–55 is preferred as providing high structural strength together with a large number of key changes. However, the number of tumblers need only equal the number of functions to be performed, so that, for example, three tumblers may be employed for performing three functions, if desired. In each case, in order to prevent removal of the "B" key in the counterclockwise-rotated position of the plug assembly 24, one or more tumblers are placed in radial alignment with the land 44 in such position, and the key changes are selected so that the second ends 78 of the so-aligned tumblers would have to project outwardly beyond the inner surface of the land for the "B" key to be removable. If desired, a land may be provided in either of the splines *ab* and *bc*, additionally or alternatively, to prevent key removal at 60° or 120° of clockwise rotation. Also, while the illustrative lock mechanism 20 is designed for operating a switch, it will be apparent that it may, alternatively, be used for other purposes, such as for operating a locking cam.

While a preferred embodiment of the invention has been illustrated and described, and reference has been made to various changes and modifications which may be made therein, it will be apparent to those skilled in the art that further changes and modifications may be made therein within the spirit and scope of the invention. It is intended that all such changes and modifications be included within the scope of the appended claims.

Having thus described the invention, what I claim as new and desire to secure by Letters Patent is:

1. A cylinder lock mechanism which comprises:

a barrel having a plurality of longitudinal internal splines therearound adapted for receiving tumbler ends, means providing at least three internal circumferentially extending tumbler movement paths on said barrel having proximal ends disposed in a first one of said splines and terminating at distal ends in respectively different ones of said splines, a key plug assembly rotatably mounted in said barrel and including a key plug and a plurality of spring-pressed plate tumblers mounted in said plug in a longitudinal series, said tumblers being mounted for reciprocal transverse movement upon insertion and withdrawal of a bitted key with opposite tumbler ends projecting alternately from opposite sides of said plug, first ones of said tumbler ends being spring-pressed to project outwardly for reception in a second one of said splines to secure the plug assembly initially in the absence of a key, said second spline being diametrically opposed to said first spline, opposite second ones of said tumbler ends being adapted to be projected outwardly and received in said first spline when a key is inserted for the purpose of freeing said plug assembly for rotation, different ones of said second tumbler ends registering with respective movement path proximal ends whereby when such tumbler ends are projected outwardly they may travel in the movement paths between the proximal and distal ends thereof, and means adjacent to at least one end of each movement path adapted for engagement with the tumbler end traveling in the path to prevent travel thereof beyond such path end, whereby a plurality of different keys may be employed for rotating said plug assembly with each key rotating the assembly to a different limited extent, said keys each engaging a different one of said tumblers having a second end registering with a movement path to cause such end to project into the movement path and thereby limit rotation of the plug assembly.

2. A lock mechanism as defined in claim 1 and including an internal land in longitudinal alignment with the distal end of one of said movement paths and in transverse alignment with at least one tumbler not registering with said one movement path, said splines including a third spline in longitudinal alignment with said land, said one movement path having its distal end disposed in said third spline, and said splines including a fourth spline diametrically opposed to said land, another one of said movement paths having its distal end disposed in said fourth spline, whereby a key engaging the tumbler traveling in said one movement path is prevented from being removed when the tumbler is at the distal end of the path, and a key engaging the tumbler traveling in said other movement path is removable when the tumbler is at the distal end of the path, the plug assembly then being secured by a tumbler first end received in said third spline.

3. A lock mechanism as defined in claim 1 and wherein the distal ends of said movement paths are disposed at least 60° from said first spline and from each other.

4. A lock mechanism as defined in claim 1 and wherein two of said movement paths extend in one direction from said first spline, and one of said movement paths extends in the opposite direction from said first spline.

5. A lock mechanism as defined in claim 1 and including interengaging stop means on said barrel and said plug assembly respectively and adapted to limit rotation of the plug assembly at the opposite extremes of the several movement paths.

6. In combination with a lock mechanism as defined in claim 1, a plurality of different single-bitted keys each having a bitting engaging a different one of said tumblers having a second end registering with a movement path to cause such end to project into the movement path for limiting rotation of the plug assembly.

7. A cylinder lock mechanism which comprises:

a barrel having a series of longitudinal internal ribs spaced apart therearound, said ribs defining between them a plurality of longitudinal internal splines adapted for receiving tumbler ends, means providing at least three internal circumferentially extending tumbler movement paths on said barrel having proximal ends disposed in a first one of said splines and terminating at distal ends in respectively different ones of said splines, and a key plug assembly rotatably mounted in said barrel and including a key plug and a plurality of spring-pressed plate tumblers mounted in said plug in a longitudinal series, said tumblers being mounted for reciprocal transverse movement upon insertion and withdrawal of a bitted key with opposite tumbler ends projecting alternately from opposite sides of said plug, first ones of said tumbler ends being spring-pressed to project outwardly for reception in a second one of said splines to secure the plug assembly initially in the absence of a key, said second spline being diametrically opposed to said first spline, opposite second ones of said tumbler ends being adapted to be projected outwardly and received in said first spline when a key is inserted for the purpose of freeing said plug assembly for rotation, different ones of said second tumbler ends registering with respective movement path proximal ends whereby when such tumbler ends are projected outwardly they may travel in the movement paths between the proximal and distal ends thereof, one of said ribs being disposed adjacent to at least one end of each movement path and adapted for engagement with the tumbler end traveling in the path to prevent travel thereof beyond such path end, whereby a plurality of different keys may be employed for rotating said plug assembly with each key rotating the assembly to a different limited extent, said keys each engaging a different one of said tumblers having a second end registering with a movement path to cause such end to project into the movement path and thereby limit rotation of the plug assembly.

8. A lock mechanism as defined in claim 7 and including an internal land in longitudinal alignment with the distal end of one of said movement paths and in transverse alignment with at least one tumbler not registering with said one movement path, said splines including a third spline in longituidnal alignment with said land, said one movement path having its distal end disposed in said third spline, and said splines including a fourth spline diametrically opposed to said land, another one of said movement paths having its distal end disposed in said fourth spline, whereby a key engaging the tumbler traveling in said one movement path is prevented from being removed when the tumbler is at the distal end of the path, and a key engaging the tumbler traveling in said other movement path is removable when the tumbler is at the distal end of the path, the plug assembly then being secured by a tumbler first end received in said third spline.

9. A lock mechanism as defined in claim 8 and wherein the distal ends of said movement paths are disposed at least 60° from said first spline and from each other.

10. A lock mechanism as defined in claim 8 and wherein said one movement path extends in one direction from said first spline, and said other movement path extends in the opposite direction from said first spline.

11. A lock mechanism as defined in claim 10 and including interengaging stop means on said barrel and said plug assembly respectively and adapted to limit rotation of the plug assembly at the opposite extremes of the several movement paths.

12. In combination with a lock mechanism as defined in claim 7, a plurality of different single-bitted keys each having a bitting engaging a different one of said tumblers having a second end registering with a movement path to cause such end to project into the movement path for limiting rotation of the plug assembly.

* * * * *